US007963578B2

(12) United States Patent
Wells et al.

(10) Patent No.: US 7,963,578 B2
(45) Date of Patent: Jun. 21, 2011

(54) INTEGRATED VACUUM GRIPPER WITH INTERNAL RELEASABLE MAGNET AND METHOD OF USING SAME

(75) Inventors: James W. Wells, Rochester Hills, MI (US); Lance T. Ransom, Essex (CA)

(73) Assignee: GM Global Technology Operations LLC, Detroit, MI (US)

( * ) Notice: Subject to any disclaimer, the term of this patent is extended or adjusted under 35 U.S.C. 154(b) by 463 days.

(21) Appl. No.: 12/130,301

(22) Filed: May 30, 2008

(65) Prior Publication Data

US 2009/0297316 A1 Dec. 3, 2009

(51) Int. Cl.
*A47G 21/10* (2006.01)

(52) U.S. Cl. ..... 294/2; 294/64.1; 294/65.5

(58) Field of Classification Search ..... 294/2, 64.1, 294/65.5; 414/737, 744.8, 752.1
See application file for complete search history.

(56) References Cited

U.S. PATENT DOCUMENTS

| | | | | |
|---|---|---|---|---|
| 3,159,418 | A | 12/1964 | Hansen | |
| 4,121,865 | A | 10/1978 | Littwin, Sr. | |
| 4,600,349 | A | 7/1986 | Vogt | |
| 5,284,416 | A * | 2/1994 | Schmidt et al. | 414/627 |
| 5,884,907 | A * | 3/1999 | Ohkoda | 271/90 |
| 6,015,174 | A * | 1/2000 | Raes et al. | 294/2 |
| 6,168,220 | B1 * | 1/2001 | Schmalz et al. | 294/64.1 |
| 6,264,185 | B1 * | 7/2001 | Isobe et al. | 269/21 |
| 6,305,228 | B1 * | 10/2001 | Kimura et al. | 73/749 |
| 6,437,560 | B1 * | 8/2002 | Kalb | 324/207.13 |
| 6,502,877 | B2 * | 1/2003 | Schick et al. | 294/65 |
| 6,538,544 | B1 | 3/2003 | Hardy | |
| 7,086,675 | B2 | 8/2006 | Jacobs | |
| 2006/0081468 | A1 * | 4/2006 | Seddon et al. | 204/298.27 |

* cited by examiner

*Primary Examiner* — Saúl J Rodríguez
*Assistant Examiner* — Stephen Vu
(74) *Attorney, Agent, or Firm* — Quinn Law Group, PLLC

(57) ABSTRACT

An integrated vacuum and magnetic gripper includes a rigid housing defining an internal chamber, and a flexible vacuum cup operatively connected thereto. A vacuum cavity is defined by the vacuum cup and a vacuum source is configured to reduce pressure in the vacuum cavity. A permanent magnet is disposed within the rigid housing, and a magnet release mechanism is configured to selectively render the magnet incapable of exerting sufficient force to hold the work piece. A pole plate may be interposed between the internal chamber and vacuum cavity, such that the pole plate forms a portion of the internal chamber and may act to provide friction on the work piece. A method of using the gripped includes operating at high acceleration while the vacuum gripper is monitored as fully operational and operating only at lower acceleration while the vacuum gripper is not fully operational.

17 Claims, 2 Drawing Sheets

INTEGRATED VACUUM GRIPPER WITH INTERNAL RELEASABLE MAGNET AND METHOD OF USING SAME

TECHNICAL FIELD

This invention relates to devices and methods for lifting and transporting objects in industrial applications, such as for movement through assembly processes.

BACKGROUND OF THE INVENTION

Industrial manufacturing processes often include repetitive lifting and transportation of work pieces that are too heavy, too large, too fragile, or must be placed with too high precision to be lifted without mechanical assistance. The lifting and transportation of these work pieces may be accomplished manually or through automated means with material handling devices. Gripping devices allow heavy, large, and complex work pieces to be transported through manufacturing processes with increased reliability and efficiency.

Vacuum-based grippers require backup mechanical clamps capable of maintaining control of the work piece or work pieces in the event of partial or total loss of vacuum pressure. Furthermore, vacuum grippers are capable of generating gripping force in only a single direction (created by air pressure on the opposite side of the vacuum chamber) and may require redundant gripping mechanisms and/or friction to hold the work piece while rotating or moving along more than one axis.

Permanent magnet-based grippers may not require backup mechanical clamps capable of holding the work piece in the event of power loss. However, these grippers often require additional structure to mechanically release the work piece from the gripper and work only on ferrous materials. Additionally, permanent magnet grippers are often incapable of picking up only one work piece from a stack or inventory of work pieces and have difficulty picking up parts of varying shapes.

SUMMARY OF THE INVENTION

A unique integrated lifting and transport device providing increased flexibility and lower investment costs is provided. The lifting and transport device includes a rigid housing defining an internal chamber. A flexible vacuum cup having an interface end is operatively connected to the rigid housing. The flexible vacuum cup also has a sealing and gripping end opposite the interface end, and a vacuum cavity defined between the gripping end and interface end.

A vacuum source is configured to reduce pressure in the vacuum cavity. A permanent magnet is disposed within the internal chamber of the rigid housing, and a magnet release mechanism is configured to selectively render the permanent magnet incapable of exerting sufficient force to hold the work piece. A pole plate may be interposed between the internal chamber and vacuum cavity, such that the pole plate forms a portion of the internal chamber.

The pole plate may act as a pressure foot providing friction force for the vacuum gripper. This device includes unique integrated structures for releasing the magnetic gripper, allowing for backup gripping while maintaining an ability to release the work piece, and minimizing damage to the work piece or surrounding equipment. Furthermore, these integrated structures control and direct the magnetic field generated by the magnetic gripper, which provides enhanced flexibility, reliability, and efficiency in the manufacturing processes.

A method of using an integrated magnetic and vacuum gripper to lift and move a work piece through a multi-stage manufacturing process is also provided. The method includes lifting and holding the work piece with a lifting and transport device having a vacuum gripper capable of holding the work piece while subjecting the work piece to a high maximum acceleration and speed. The lifting and transport device also has a magnetic gripper capable of holding the work piece while the lifting and transport device subjects the work piece to lower maximum accelerations and speeds.

The method further includes monitoring the vacuum gripper to determine if it has sufficient vacuum pressure to hold the work piece while the lifting and transport device subjects the work piece to the high maximum acceleration. The lifting and transport device operates at the high maximum acceleration as long as the vacuum gripper has sufficient vacuum pressure to hold the work piece. The lifting and transport device lifts and holds the work piece with the magnetic gripper and operates at the lower maximum acceleration when the vacuum gripper does not have sufficient vacuum pressure to hold the work piece. The lifting and transport device may continue to operate at the lower maximum acceleration until the multi-stage manufacturing process reaches a predetermined maintenance point or break.

The above features and advantages and other features and advantages of the present invention are readily apparent from the following detailed description of the best modes and embodiments for carrying out the invention when taken in connection with the accompanying drawings.

DESCRIPTION OF PREFERRED EMBODIMENTS

Figure 1:
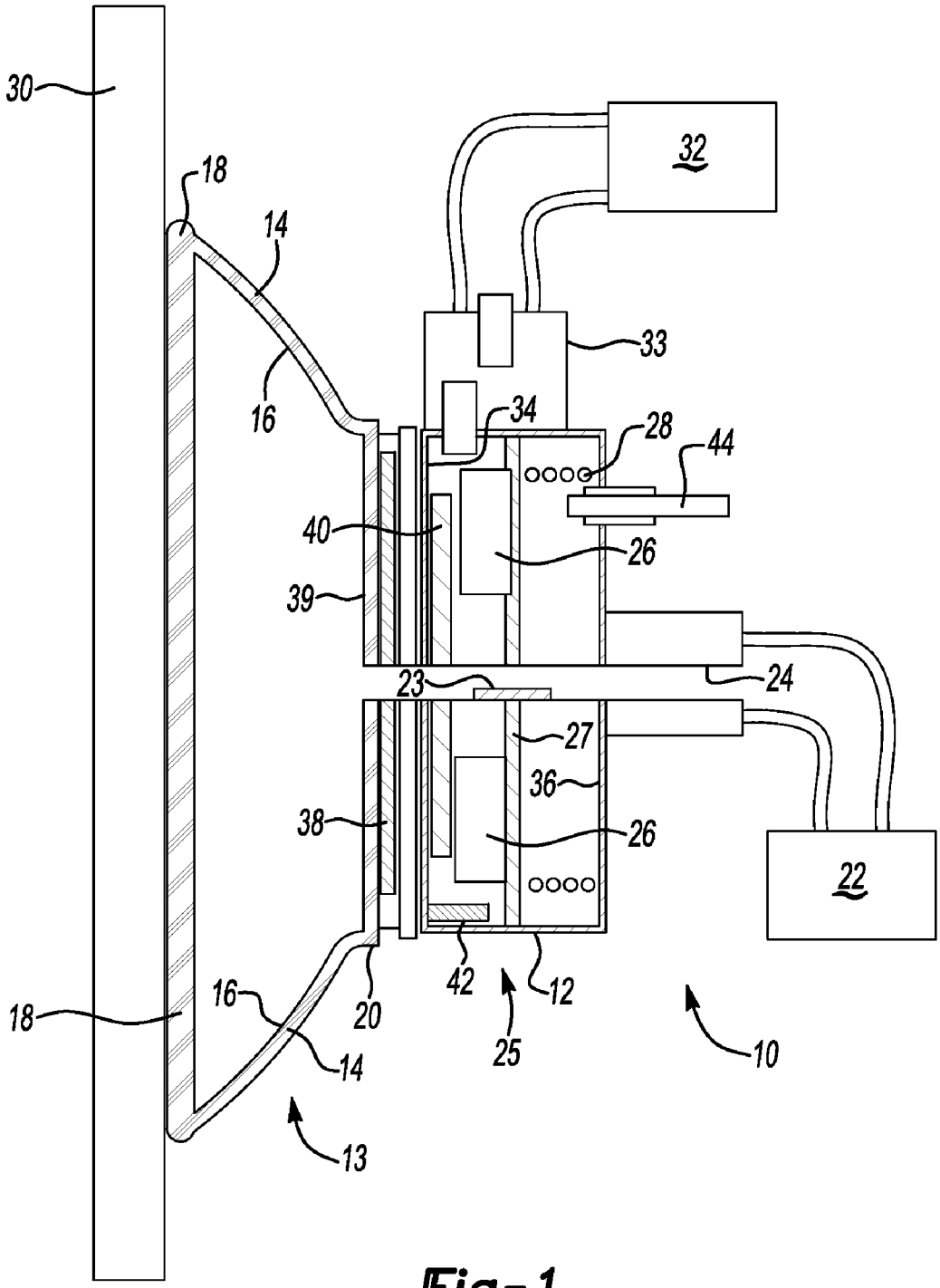
FIG. 1 is a schematic cross section of one embodiment of an integrated vacuum-magnetic gripper.

Referring to the drawings, wherein like reference numbers correspond to like or similar components throughout the several figures, there is shown in FIG. 1 a cross sectional view of a portion of one embodiment of an integrated releasable vacuum-magnetic gripper 10 (hereinafter referred to as integrated gripper 10).

A rigid housing 12 acts as a structural support for the integrated gripper 10, which has two gripper units: a vacuum gripper 13 and a magnetic gripper 25. As will be recognized by those having ordinary skill in the art, rigid housing 12 may be constructed of panels or sheets on a frame, or may be a unitary or integral structure.

Attached to the rigid housing 12 is a vacuum cup 14 which acts as the primary gripping device and flexible seal for the vacuum gripper 13 of integrated gripper 10. The vacuum cup 14 forms a vacuum cavity 16 which can be evacuated of air by a vacuum source 22. This creates a relative vacuum in vacuum cavity 16, which lifts a work piece 30 (by the relative force created by atmospheric air pressure opposite the work piece 30 from the vacuum), which is in contact with a gripping lip or gripping end 18.

Vacuum cup 14 may be constructed of a molded elastomer. The gripping end 18 may be molded integrally as a flexible annular lip capable of providing a pressure seal on the surface of the work piece 30. Those having ordinary skill in the art will recognize other materials and various shapes capable of holding a vacuum and sealing along gripping end 18 that may be used for construction of the vacuum cup 14, and will further recognize that gripping end 18 could be made of a different, or differently-treated, material than the remainder of vacuum cup 14.

The vacuum source 22 could be attached directly to the vacuum cup 14, or create the vacuum through a central channel 24 in the rigid housing 12 (as shown in the embodiment of FIG. 1). As will be recognized by those having ordinary skill in the art, some embodiments of the vacuum cup 14 may incorporate multiple vacuum chambers 16, each in communication with the vacuum source 22, to maintain multiple sources of vacuum pressure.

A vacuum sensor 23 may be included in the rigid housing 12, located directly in the central channel 24 (as shown in FIG. 1), or elsewhere in the vacuum generation system (which includes vacuum source 22). One advantage to having the vacuum sensor 23 in the rigid housing 12 or central channel 24 is that it could detect vacuum cup 14 sealing issues, cup rips or damage; or upstream leaks, hose kinks and other issues with the transmission of vacuum pressure from the vacuum source 22 to the rigid housing 12 and vacuum chamber 16.

The vacuum cup 14 attaches to the rigid housing 12 via a hub or interface end 20. To facilitate maintenance, repair, and flexible operation of the integrated gripper 10, the interface end 20 is configured to be attached, removed, and reattached to the rigid housing without damaging the vacuum cup 14. As will be recognized by those having ordinary skill in the art, the same or similar interface end 20 could be incorporated into differently-shaped vacuum cups 14, allowing multi-functionality in the vacuum cup design while retaining the same rigid housing 12.

Within the rigid housing 12 is a magnetic field source 26, which may be a single magnet or an array of magnets, and acts as the primary gripping device for the magnetic gripper 25. In the embodiment shown in FIG. 1, magnetic field source 26 is an array of two permanent magnets supported by a plate 27. However, as will be recognized by those having ordinary skill in the art, magnetic field source 26 could be a larger array of permanent magnets, or an array of both permanent and electromagnets.

The magnetic field source 26 and plate 27 separate the interior of the rigid housing 12 into two chambers, a magnetic chamber 34 and a spring chamber 36. A vent mechanism 44 may be used to regulate pressure in the spring chamber 36.

In operation, the integrated gripper 10 may be attached to a robot (not shown) or another multi-dimensional actuator (not shown), by mounting the rigid housing 12. The robot or other end effector would be capable of moving the integrated gripper 10 and the work piece 30 through a manufacturing process or processes. In such an application, the magnetic gripper 25 may function as either (or both) a primary or a backup gripper. Furthermore, multiple integrated grippers 10 may be attached to a robot or array of end effectors to handle multiple work pieces 30 or operate together to handle a large, complex-shaped work piece 30.

While the integrated gripper 10 is functioning normally, the vacuum gripper 13 carries the whole load of work piece 30 while the integrated gripper 10 moves at full speed through the manufacturing process. However, if there is a loss of vacuum pressure—caused by damage to the vacuum cup 14 or a power failure in the vacuum source 22, et cetera—the magnetic field source 26 can engage the work piece 30, such that the work piece 30 is carried by the magnetic gripper 25.

Both the vacuum and magnetic gripper 13 and 25 can be operated independently or in tandem to control the work piece. In the case of tandem operation, the magnetic gripping function (25) acts as a back-up part retention reserve system in case the vacuum is lost at any time during the lifting and transport sequence. In the case of a pause, activity break, or other extended shut down of the lifting and transport sequence, the magnetic retention system (25) would statically maintain control of the work piece 30 without the sustained energy requirements to generate a continuous vacuum pressure, thus providing a relative energy savings.

Engagement of the magnetic field source 26 can be triggered in myriad ways. One mechanism to engage the magnetic field source 26 is a spring 28, which biases the magnetic field source 26 towards the work piece 30. In such an embodiment, the magnetic gripper 25 is both a primary and backup gripper and operates in tandem with the vacuum gripper 13; it provides gripping force whenever the work piece 30 is engaged with the vacuum cup 14, but also continues to grip work piece 30 if vacuum pressure is lost.

To release the work piece 30, both the vacuum and magnetic gripping mechanisms 13 and 25 need to be released. Selective release of the vacuum gripper 13 occurs simply by turning off the vacuum source 22 or otherwise removing or venting the vacuum inside of vacuum cavity 16. Alternatively, the external vacuum generation system (including vacuum source 22) can provide this function, including the temporary application of positive pressure to the vacuum cavity 16 to assist in quickly reliving the vacuum and providing a part "blow-off" function.

To selectively release the magnetic gripper 25, myriad options are available. One method of releasing the magnetic gripper 25 involves physically moving the magnetic field source 26 away from the work piece 30 (rightward, as viewed in FIG. 1). This movement can be accomplished by a physical actuator (not shown) or by introducing compressed air from a pressure source 32 into the magnetic chamber 34. Increased pressure in the magnetic chamber 34 biases the magnetic field source 26 away from the work piece 30.

Gas exchange, and therefore pressure regulation, between pressure source 32 and magnetic chamber 34 is maintained by regulator mechanism 33. As will be recognized by those having ordinary skill in the art, some embodiments of regulator mechanism 33 could also control pressure in the spring chamber 36. Alternative methods of rendering the magnetic field source 26 incapable of exerting sufficient force to hold the work piece 30, and thereby releasing the work piece 30, are discussed below.

Combination of both the vacuum gripper 13 and magnetic gripper 25 in the integrated gripper 25 may allow the integrated gripper 10 to operate without backup mechanical clamps. Furthermore, magnetic gripper 25 is capable of holding the work piece 30 indefinitely during power outages or other loss of vacuum function.

Attached to, or forming a portion of, the rigid housing 12 is a pole plate 38. This integrated pole plate 38 sits between the magnetic chamber 34 and the vacuum cavity 16 and serves several functions in the integrated gripper 10. Pole plate 38 focuses and conducts the magnetic field produced by magnetic field source 26, which results in a magnetic gripping force that is more precise and less likely to damage the work piece 30.

In the embodiment shown in FIG. 1, pole plate 38 is generally disc shaped and vacuum cup 14 generally conical.

However, those having ordinary skill in the art will recognize that the shape of the vacuum cup 14 and either the pole plate 38 or associated area of rigid housing 12 may be modified for specific applications to accommodate different shapes and sizes of the work piece 30.

Vacuum grippers can provide force along only one axis (running left to right in FIG. 1). Therefore, in order to restrict lateral movement and rotation, the vacuum gripper 13 must use friction to restrain the work piece 30 while the integrated gripper is using primarily vacuum pressure to hold work piece 30.

The friction force is provided by a pressure foot in the integrated gripper 10. In this embodiment, pole plate 38 acts as the pressure foot for the vacuum cup 14. Other embodiments may incorporate a friction surface 39—such as thin webbing or other friction-inducing surfaces and structures—molded into the center of the vacuum cup 14 in close contact with the underlying pole plate.

The friction surface 39 of pressure foot (such as pole plate 38) may also have a layer of thin, high friction material such as an elastomer. This area may also be slightly relived with shallow grooves in a cross or other pattern that allows the vacuum access to the interface between the pressure foot and the work piece 30. This area could also be optimized to minimize the gap between the pole plate 38 and the part for the most effective magnetic circuit.

The embodiment of an integrated gripper 10 shown in FIG. 1 further includes an electromagnet 40 within the rigid housing 12. The electromagnet 40 can be selectively energized to assist the magnetic field source 26 in gripping the work piece 30. In one embodiment, the electromagnet 40 can also be selectively energized to neutralize or reverse the magnetic field produced by the magnetic field source 26. Such an embodiment would allow the magnetic gripper 25 to release the work piece 30 without the need to physically move the magnetic field source 26 away from the work piece 30.

Some applications may require the integrated gripper 10 to pick up and move a thin, ferrous work piece 30, such as sheet metal, from a stack without removing more than one work piece from the stack. One embodiment of the integrated gripper 10 could first use the vacuum gripper 13 to lift a single work piece 30 without engaging any of the remaining sheets. Magnetic gripper 25 could then engage the work piece 30 once it has cleared the stack.

In the embodiment shown in FIG. 1, the integrated gripper 10 includes a part sensor 42. Integration of a part sensor allows an operator or a control system overseeing the manufacturing process to know whether or not the work piece 30 is, in fact, engaged with the integrated gripper 10. The integrated part sensor 42 assists with system timing and monitoring, and lets the system determine whether or not backup systems—such as the magnetic gripper 25—need to be engaged and selective action to be taken to slow or stop the operation.

Those having ordinary skill in the art will recognize many possible methods of sensing engagement of the work piece 30. One embodiment of an integrated part sensor 42 that can be incorporated into the integrated gripper 10 is an inductive proximity switch. A ferrous work piece 30 will cause a voltage change in a coil on the inductive proximity switch of the integrated part sensor 42, and this voltage change will alert the control system that the work piece 30 is near.

An alternative integrated part sensor 42 is a Hall Effect sensor, which is a magnetic sensor that senses changes in the magnetic field caused by engagement of the work piece 30. Those skilled in the art will recognize other part sensors, such as, without limitation, optical sensors detecting the presence and distance of objects in relation to the gripping end 18. The integrated part sensor 42 could be located outside of the rigid housing 12, allowing maximum flexibility of placement; or inside of rigid housing 12, allowing the integrated part sensor 42 to be fully enclosed and protected from damage or interference.

A method of lifting and moving the work piece 30 through a multi-stage manufacturing process is also provided. The integrated gripper 10 is configured to hold the work piece 30 with two different levels of force: the vacuum gripping function (supplied by the vacuum gripper 13) is capable of holding the work piece 30 under high acceleration (high loads), and the magnetic gripping function (supplied by the magnetic gripper 25) is capable of holding the work piece 30 only at lower levels of acceleration and speed.

Figure 2:
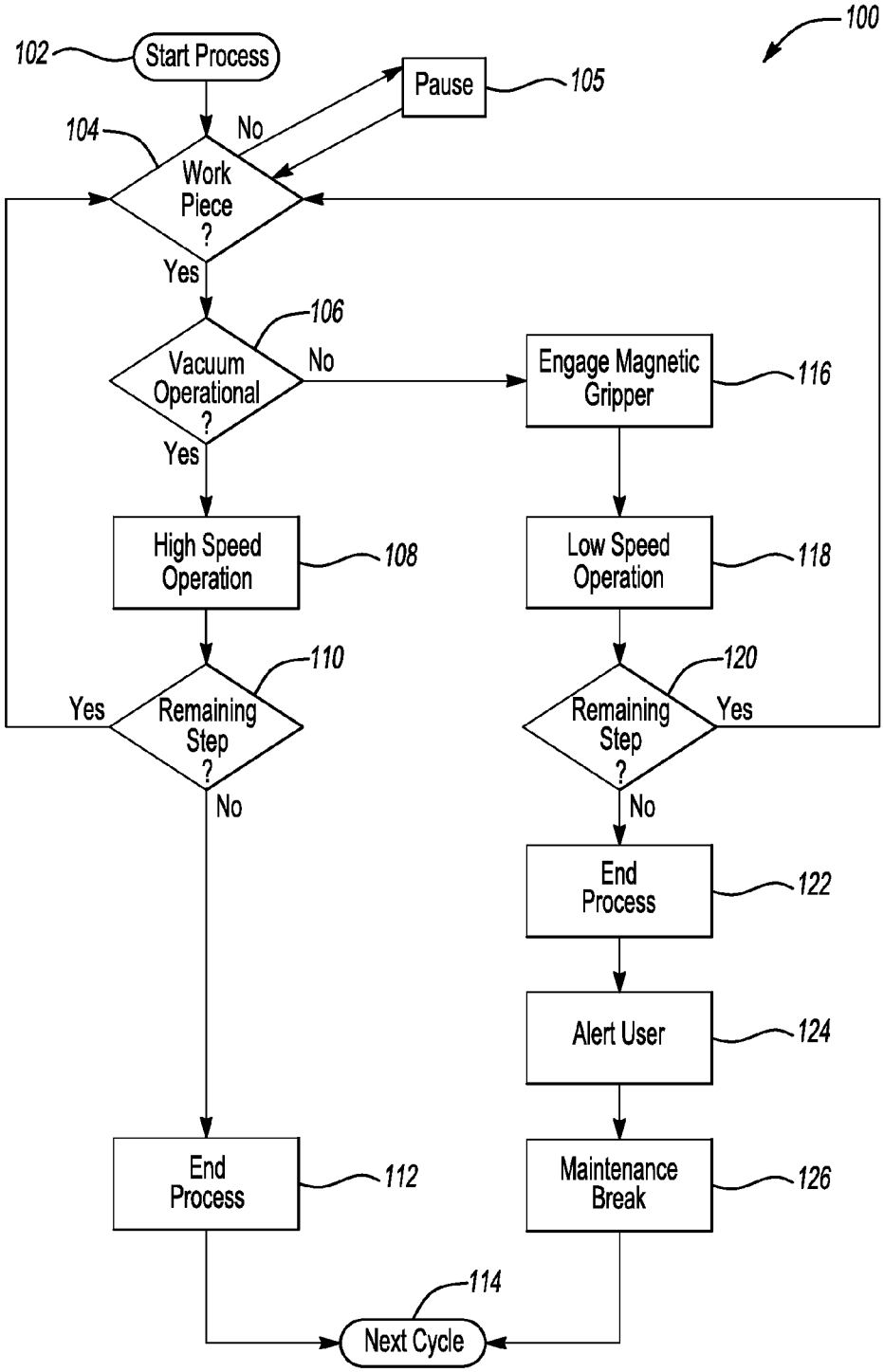
FIG. 2 is a flow chart diagram of one embodiment of a method of using an integrated vacuum-magnetic gripper to lift and move a work piece through a multi-stage manufacturing process.

FIG. 2 shows an embodiment of a method 100 of using an integrated gripper 10 to lift and move the work piece 30 through a multi-stage manufacturing process. The method 100 may, but need not be, used in conjunction with the structure and components of integrated gripper 10. For descriptive purposes, the method 100 is described with respect and reference to integrated gripper 10. The method 100 begins at start process 102, where the vacuum source 22 begins removing air from vacuum chamber 16 and the integrated gripper 10 moves to pick up the work piece 30 using only the vacuum gripper 13.

At decision step 104, the part sensor 42 checks to see that the work piece 30 is, in fact, engaged. If no work piece is engaged, the system will stop for a pause 105 and then check again, until a work piece 30 is engaged. Often, there is no point in continuing the manufacturing process without a work piece. If the work piece 30 is engaged with the integrated gripper 10, decision step 106 will determine whether or not the vacuum is operating properly by sensing the relative vacuum being maintained in the vacuum chamber 16. If the vacuum gripper 13 has sufficient vacuum pressure to hold the work piece 30 at a predetermined level of force, method 100 moves to high speed operation 108.

While the vacuum gripper 13 is fully operational, the method 100 can move the integrated gripper 10 and work piece 30 through the manufacturing process at maximum speeds and acceleration. After method 100 completes its current step in the manufacturing process at high speed operation 108, decision step 110 will determine whether a further step remains in the manufacturing process or whether the process is complete (a finished work piece 30). If further steps are involved in the manufacturing process, method 100 will again verify engagement of the work piece in decision 104 and repeat steps 106-110 until no manufacturing steps remain.

Once the manufacturing process is complete, an end process 112 will run. In the end process 112, the work piece 30 might be deposited in an inventory or moved to a transfer point for another manufacturing or assembly process. After releasing the work piece 30, the method 100 will move the integrated gripper 10 into position for its next cycle 114, which may be: a repeat of the method 100, a break for the end of one labor shift and beginning of another labor shift, a break for routine maintenance and inspection, or reconfiguration for a different work piece or different manufacturing process.

During each step in the manufacturing process, method 100 will perform decision step 106 to ensure that the vacuum gripper 13 is fully operational. Whenever the system determines that the there is a problem with vacuum gripper 13—due to loss of power to vacuum source 22 or some other failure that causes vacuum chamber 16 to lose its proper vacuum pressure—magnetic gripper 25 will automatically engage in step 116. The system will also slow to a low speed operation 118.

Steps 116 and 118 ensure that the work piece 30 is properly held by the integrated gripper 10 while still allowing the manufacturing process to continue (at reduced speed and efficiency) until it is feasible to halt the process to repair or replace the integrated gripper 10. In this embodiment, reducing the manufacturing process to low speed operation is necessary because the vacuum gripper 25 is not capable of reliably holding the work piece 30 under the greater loads incurred during high speed operation 108. By using the magnetic gripper 25 as a backup mechanism, the integrated gripper 10 does not require backup mechanical clamps. This can greatly facilitate the flexibility of particular gripping end effectors in grasping many different shaped and sized parts within a certain range, since the limiting nature of the application of fixed mechanical clamping is no longer required.

After switching to low speed operation 118, method 100 continues much as if the vacuum were operational. In decision step 120 (like decision step 110) the system determines whether further manufacturing steps are necessary or if the system can proceed to end process 122 (which, except for the lowered speed, is identical to end process 112).

Once the manufacturing process has ended (and work piece 30 deposited, as described above) following a failure of the vacuum gripper 13, the system alerts the controller of the manufacturing process in step 124 and enters a maintenance break 126. This maintenance break 126 may be scheduled to coincide with labor shift change, an inspection and maintenance break, or a break to reconfigure the integrated gripper 10 for a different work piece 30.

During the maintenance break 126, workers can assess the reasons for failure of the vacuum gripper 13 and either make necessary repairs or replace the integrated gripper 10. Once the vacuum gripper 13 has been tested and is again operational, the integrated gripper 10 may be moved into position for the next cycle 114.

Those having ordinary skill in the art will recognize alternative embodiments and variations to the method 100 described above. One alternative uses both the vacuum and magnetic gripping functions to actively grip the work piece during high speed operation (similar to steps 106-110). This adds additional gripping force while the integrated gripping device is fully operational, but retains the ability to switch to solely magnetic gripping for low speed operation and limp-home modes.

A further alternative step to method 100 (or alternatives) would allow the whole process to be paused or shut down and the vacuum shut off for an energy savings. This may occur, for example, during a labor shift change that occurs in the middle of the manufacturing process being implemented with the integrated gripper. During this stage, the magnetic gripper would engage to hold the part such that the part may be retained indefinitely until the process is restarted. This step may greatly reduce the energy required to hold and pause the manufacturing process, because a permanent magnet requires far less energy to hold the work piece than a vacuum.

While the best modes and other modes for carrying out the invention have been described in detail, those familiar with the art to which this invention relates will recognize various alternative designs and embodiments for practicing the invention within the scope of the appended claims.

The invention claimed is:

1. A lifting and transport device for lifting a work piece, comprising:

a rigid housing defining an internal chamber;

a flexible vacuum cup having an interface end operatively connected to said rigid housing, a gripping end opposite said interface end, and a vacuum cavity defined between said gripping end and said interface end;

a vacuum source configured to selectively reduce pressure in said vacuum cavity of said flexible vacuum cup;

a magnetic field source disposed within said internal chamber of said rigid housing; and a magnet release mechanism configured to selectively render said magnetic field source incapable of exerting sufficient force to hold the work piece.

2. The lifting and transport device of claim 1, further comprising a pole plate interposed between said internal chamber and said vacuum cavity.

3. The lifting and transport device of claim 2, wherein said pole plate cooperates with said rigid housing to define a portion of said internal chamber.

4. The lifting and transport device of claim 3, further comprising a friction surface on said pole plate, wherein said friction surface is configured to provide friction between the work piece and the lifting and transport device.

5. The lifting and transport device of claim 1, wherein said magnetic field source is a permanent magnet.

6. The lifting and transport device of claim 5, further comprising an electromagnet disposed within said internal chamber of said rigid housing.

7. The lifting and transport device of claim 6, wherein said magnet release mechanism includes said electromagnet, and wherein said electromagnet is configured to sufficiently counteract the magnetic field of said permanent magnet to render said permanent magnet incapable of exerting sufficient force to hold the work piece.

8. The lifting and transport device of claim 1:

wherein the lifting and transport device is configured to hold a first work piece having a first size and shape and a second work piece having a second size and shape different from said first size and shape, and wherein the lifting and transport device is configured to hold one of said first and second work pieces without a mechanical clamp and without reduced pressure in said vacuum cavity.

9. The lifting and transport device of claim 1, wherein said magnet release mechanism further includes a compressed air source configured to bias said magnetic field source away from said flexible vacuum cup.

10. The lifting and transport device of claim 1, further comprising a spring interposed between said rigid housing and said magnetic field source, wherein said spring is configured to bias said magnetic field source toward said flexible vacuum cup.

11. The lifting and transport device of claim 1, further comprising an integrated part sensor, wherein said integrated part sensor is configured to detect the location of the work piece.

12. The lifting and transport device of claim 11, wherein said integrated part sensor is disposed within said internal chamber of said rigid housing.

13. A lifting and transport device for lifting a work piece, comprising:

a rigid housing defining an internal chamber;

a flexible vacuum cup having an interface end configured such that said interface end is operatively connected to said rigid housing, a gripping end opposite said interface end, and a vacuum cavity defined between said gripping end and said interface end;

a vacuum source configured to selectively reduce pressure in said vacuum cavity of said flexible vacuum cup;

a permanent magnet disposed within said internal chamber of said rigid housing;

a magnet release mechanism configured to selectively render said permanent magnet incapable of exerting sufficient force to hold the work piece; and a pole plate interposed between said internal chamber and said vacuum cavity, wherein said pole plate forms a portion of said internal chamber.

14. The lifting and transport device of claim 13, further comprising an electromagnet disposed within said internal chamber of said rigid housing.

15. The lifting and transport device of claim 14, wherein said magnet release mechanism includes said electromagnet, and wherein said electromagnet is configured to sufficiently counteract the magnetic field of said permanent magnet to render said permanent magnet incapable of exerting sufficient force to hold the work piece.

16. The lifting and transport device of claim 15, wherein said pole plate is configured to provide friction between the work piece and the lifting and transport device.

17. The lifting and transport device of claim 16, wherein the lifting and transport device is characterized by a lack of mechanical clamps.

* * * * *